US006985345B2

(12) United States Patent
Hermann et al.

(10) Patent No.: US 6,985,345 B2
(45) Date of Patent: Jan. 10, 2006

(54) METHOD AND A DEVICE FOR OPERATING AN ELECTRO-MAGNET ON AN INTRINSICALLY SAFE DIRECT CURRENT CIRCUIT

(75) Inventors: Hemut Hermann, Bochum (DE); Hans-Udo Rheiner, Menden (DE); Jens Titschert, Lunen (DE)

(73) Assignee: DBT Automation GmbH, Lunen (DE)

( * ) Notice: Subject to any disclaimer, the term of this patent is extended or adjusted under 35 U.S.C. 154(b) by 0 days.

(21) Appl. No.: 10/391,699

(22) Filed: Mar. 19, 2003

(65) Prior Publication Data

US 2003/0179534 A1 Sep. 25, 2003

(30) Foreign Application Priority Data

Mar. 19, 2002 (DE) ..... 102 12 092

(51) Int. Cl.
*H01H 47/00* (2006.01)

(52) U.S. Cl. ..... 361/139; 361/153; 361/154; 361/186; 361/187; 361/194; 251/129.01; 251/129.02; 251/129.15

(58) Field of Classification Search ..... 361/139, 361/152–154, 159, 160, 166, 168.1, 169.1, 361/170, 186, 187, 194; 251/129.01, 129.02, 251/129.05, 129.15
See application file for complete search history.

(56) References Cited

U.S. PATENT DOCUMENTS

| | | | | |
|---|---|---|---|---|
| 3,946,285 A | | 3/1976 | Beery et al. | |
| 3,988,664 A | | 10/1976 | Beery et al. | |
| 4,291,358 A | | 9/1981 | Dettmann et al. | |
| 4,557,293 A | | 12/1985 | Guens et al. | |
| 4,823,825 A | | 4/1989 | Buchl | |
| 4,870,364 A | | 9/1989 | Trox et al. | |
| 5,245,501 A | | 9/1993 | Locher et al. | |
| 5,293,551 A | * | 3/1994 | Perkins et al. | 361/154 |
| 6,024,059 A | * | 2/2000 | Kamimaru et al. | 123/90.11 |
| 6,262,620 B1 | | 7/2001 | Jenski et al. | |
| 6,377,143 B1 | * | 4/2002 | Zhou et al. | 335/132 |

FOREIGN PATENT DOCUMENTS

| | | |
|---|---|---|
| DE | 42 02 601 A1 | 8/1993 |
| DE | 44 25 987 A1 | 1/1996 |
| DE | 196 47 215 A1 | 7/1997 |
| DE | 197 28 840 A1 | 1/1999 |
| DE | 100 34 830 A1 | 2/2002 |
| GB | 2 181 310 A | 4/1987 |
| GB | 2 205 147 A | 11/1988 |
| GB | 2 220 730 A | 1/1990 |
| GB | 2 279 829 A | 1/1995 |

* cited by examiner

*Primary Examiner*—Ramon M. Barrera
(74) *Attorney, Agent, or Firm*—Cook, Alex, McFarron, Manzo, Cummings & Mehler, Ltd.

(57) ABSTRACT

The present invention relates to a method for operation of an electro-magnet (2, 3) connected to an intrinsically safe direct current circuit which can be switched under control between two positions for the operation of the closing body of a hydraulic valve (5, 6), whereby using of an electronic control unit, the coil windings of the electro-magnet (2, 3) are taken in the pull-in phase of the armature of the electro-magnet to an exciting current and in the retaining phase of the armature to a lower retaining current as opposed to the excitating current, and a device with which the retaining current reduction is realized.

11 Claims, 1 Drawing Sheet

Figure 1:
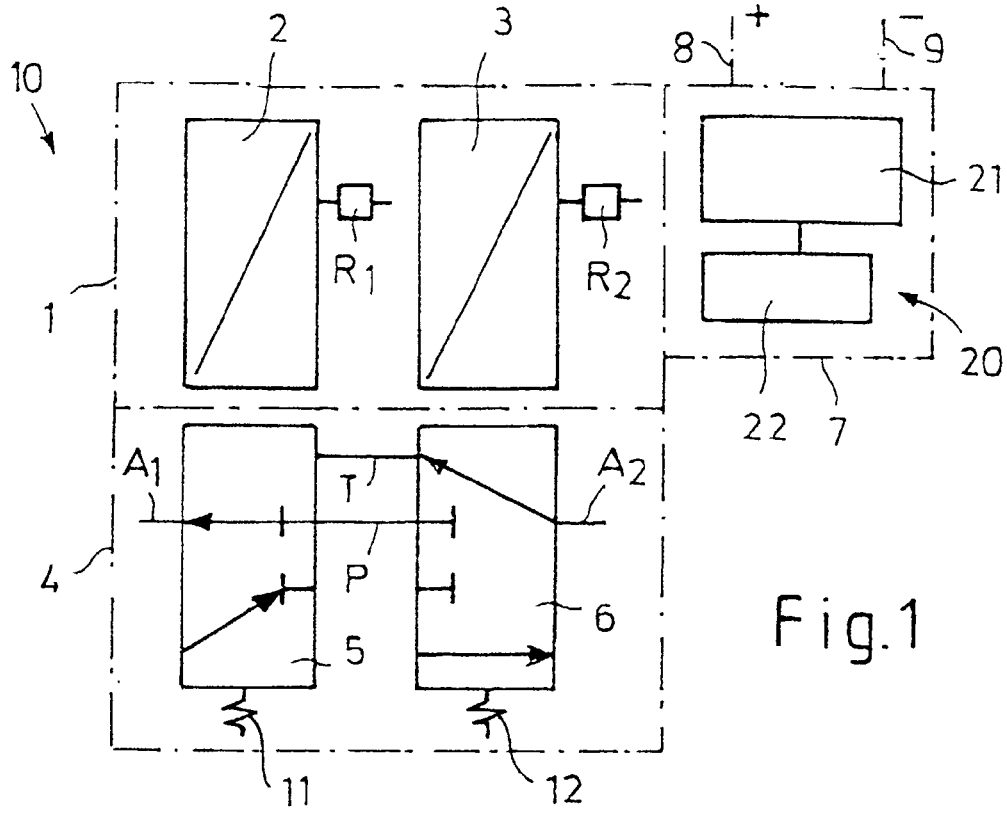

METHOD AND A DEVICE FOR OPERATING AN ELECTRO-MAGNET ON AN INTRINSICALLY SAFE DIRECT CURRENT CIRCUIT

The present invention relates to a method of operation of an electro-magnet connected to an intrinsically safe direct current circuit, controlled to switch between two positions for the operation of the closing body of a hydraulic valve, whereby by means of an electronic control unit an exciting current is fed to the coil windings of the electro-magnet are taken in the pull-in phase of the armature of the electro-magnet and in the retaining phase of the armature a retaining current which is relatively lower than as opposed to the exciting current is fed in. The present invention further relates further to a device for the operation of an electro-magnet connected to an intrinsically safe direct current circuit, which can be controlled backwards and forwards between two switching positions for the operation of the closing body of the hydraulic valve with an electro-magnet having a coil winding and an armature and with an electronic control unit, by means of which the current supplied in the pull-on phase of the armature can be adjusted to an exciting current and in the retaining phase to a lower retaining current.

In the operation of underground electro hydraulic installations such as for instance support units for the support of underground mining areas behind the mining face, owing to the risk of explosion and firedamp danger, for the electrical supply of the electro-magnet to be switched an intrinsically safe direct current circuit is provided. It has been previously proposed here that using an electronic control unit associated with the electro-magnet the holding current in the retaining phase can be reduced to a level lower than that of the excitation current (DE 32 29 835 C2). In underground mining, electro-magnets with suitable control devices are spoken of also as electro-magnets with retaining current reduction. In the reduction of the retaining current to the lower retaining current level the force of remanence, which is generated during the operating process of the electro-magnet is used to hold the armature and consequently also to hold the closing body of the hydraulic valve in one of the two switched positions. The armature of the electro-magnet and the closing body of the hydraulic valve are as a rule moved back into the starting position after the electro-magnet is turned off by the returning force of a spring.

In the underground application of electro-magnets as actuators for hydraulic valves on intrinsically safe current circuits, several problems have to be taken into consideration. The exciting current in the pull-on phase must be dimensioned sufficiently high to assure the operation of the hydraulic valve even with voltage peaks or increased operating pressure on the hydraulic side. In the retaining phase the retaining current level and the retaining force applied by the electro-magnet must be sufficiently high so as to he able safely to maintain the operated position even with the previously mentioned voltage peaks and operating pressure increases. On the other side using a single intrinsically safe direct current circuit, the maximum possible number of electro hydraulic valves in the support units should be controllable and operated in order to keep the expenditure on apparatus deployed underground on intrinsically safe current circuits low. These basic problems for intrinsically safe underground current circuits is described in DE 32 29 835 C2 to which express reference is made on this.

As well as the previously proposed DE 32 29 835 C2 it has been proposed that between the armature of the electro-magnet and the closing body of the hydraulic valve a transmission element such as for instance a lever is provided (DE 37 17 403; DE 38 23 681 A1) so as to be able to adjust the operating positions as precisely as possible and possibly to be able to reduce the operating force to be exerted by the electro-magnet by exploitation of the lever ratio. In a further system for electro hydraulic valves with retaining current reduction the current reduction takes effect after a fixed time interval beginning with the excitation of the electro-magnet (EP 00 06 843 A1).

All the previously proposed methods and devices for operating the electro-magnets of an electro hydraulic valve have the disadvantage that they operate with current reduction dependent on a fixed supply voltage. Taking account of the operating voltage reserves basically available in underground intrinsically safe current circuits, this leads to a higher current than necessary flowing in the holding phase and to more energy than necessary being used in the retaining phase up to the switching over from the pull-on phase. This marginally increased consumption for a single electro-magnet has potential implication in underground support installations, since in an underground face over 200 support units with associated electro hydraulic valves have to be operated. The technology previously applied for reduction of the holding current sets limits on the economy to be obtained in underground support installations. In order to maintain the economy of underground support installations, a significantly higher hydraulic pressure must be controllable without the energy consumption of individual valves and of the overall support installation increasing.

It is an aim of the present invention to provide a method and a device for operating electro hydraulic valves which make possible a reduction of the energy used for the individual electro-magnets.

Accordingly a first aspect of the present invention is directed to a method as described in the opening paragraph of the present specification, in which the actual current in the coil winding following the actuation of the electro-magnet is continuously measured and evaluated to detect the movement of the armature. The method according to the present invention is based here on the one hand on the knowledge that the power of the electro-magnet actuator remains proportional to the current flow and on the other hand to the knowledge that the movement of the actuator sets up an opposing induction in the coil winding of the magnet, which drives down the actual current in the coil winding. The immediate detection of the movement of the armature on or close in time to the beginning of the movement of the armature makes possible an optimised management of the method with regard to the regulation of energy.

In a preferred embodiment the movement of the armature is detected using at least one change of gradient in the measured actual current curve. In general, after the actuation of the electro-magnet two changes of gradient can be detected in the measured actual current curve, whereby the first change of gradient occurs on the onset of movement of the armature and the second change of gradient at the ending of the movement of the armature. In order to regulate the energy consumption of the electro-magnet using the method preferably the actual current is used as a control value for the reduction of the current fed to the retaining current level. Since with the onset and the ending of the movement of the armature a change occurs in the measured actual current, especially a change of gradient, with the method according to the present invention it is possible, based on the continual monitoring of the actual current in the coil winding, to find the optimal time point for reduction of the current feed to the retaining current and for the reduction to the retaining current. In a preferred embodiment the measured actual current is taken to a regulator device, which closely following the onset of a second change of gradient in the measured actual current curve reduces the current fed to the lower retaining current. In a preferred embodiment the regulator device is formed from a proportional regulator, which regulates the current fed in to a target current. The proportional regulator can here be realised by means of a microprocessor whereby it is advantageous if the target current can be parametrised by control software.

Advantageously in the retaining phase the current fed is kept to the lower retaining level by pulsed control especially by pulse width modulation. By pulse width modulation the loss power in the retaining phase can be minimised in comparison to conventional regulation of the control voltage applied to the coil winding.

The continuous measurement of the actual current foreseen according to the invention can not only be applied for optimising the reduction of the holding current but also for detecting operational interference and wear on the electro hydraulic switching devices. In order to realise this preferably the electronic control has a microprocessor, which detects the onset of gradient changes in the measured actual current curve and by comparison with reference values evaluates these for the diagnosis of failures of operating disturbances and/or of wear in the electro-magnets. By the continual measurement of current and the comparison of the actual movement of the magnet armature with the optimum stored as reference movement behaviour important operating information can be derived. Thus for instance the current density at the beginning of the movement of the armature is a criterion for its freedom of movement. Too high a current required for initiating the movement of the armature points towards the onset of corrosion, damage or to too high switching pressures. Also the period, which passes between the two changes in gradient, can he used as a criterion for the diagnosis of failure. Apart from this, short circuits in the magnet coil can be detected by too high an actual current, signal interruptions in the working circuit owing to lacking or too low a current, and earth leakage problems by the exceeding of the required holding current level in spite of a completely opened regulator device.

Accordingly a second aspect of the present invention is directed to a device according to the opening paragraph of the present specification wherein a measuring device for the measurement of the actual current in the coil winding and an evaluating device for detection of a movement of the armature using the measured actual current. The present invention, consequently, establishes the continuous measurement of the actual current in the coil winding and detects the movement of the armature also using the device, so as with the aid of the test device and the evaluation device, the optimum point of time inter alia, at which the retaining current reduction should be initiated. Preferably the coil winding of the electro-magnet is connected in series to a test resistor for the measurement of the actual current. It is further advantageous if the evaluation device comprises a control unit formed from a microprocessor. Such microprocessors such as for instance PIC processors or DSP processors can be integrated into the housing of the device and become a permanent component of the electro-magnet. Using appropriate control software a control device especially a proportional regulator can be formed using the microprocessor and from the movement behavour of the armature of the magnet conclusions can be drawn on mechanical, electronic, or magnetic failures. In a preferred embodiment the measured actual current is taken to the microprocessor as a control value for the reduction of the current fed into the retaining current. In order to minimise energy losses in the retaining current reduction, the electronic control unit can have a pulse width modulating unit for the adjustment and maintenance of the current fed to the lower retaining current level.

In a preferred embodiment a contribution to further reduction in the current requirement of a single device is made if the electro-magnet has a case made of ferro magnetic material with two accepting borings for two electro-magnet inserts with associated coil windings and armatures, which preferably can be controlled via a common electronic control unit. Such doubled electro-magnets are especially widely used in underground applications and permit a higher magnetic force to be obtained with the same coil current owing to the higher amount of iron.

Figure 2:
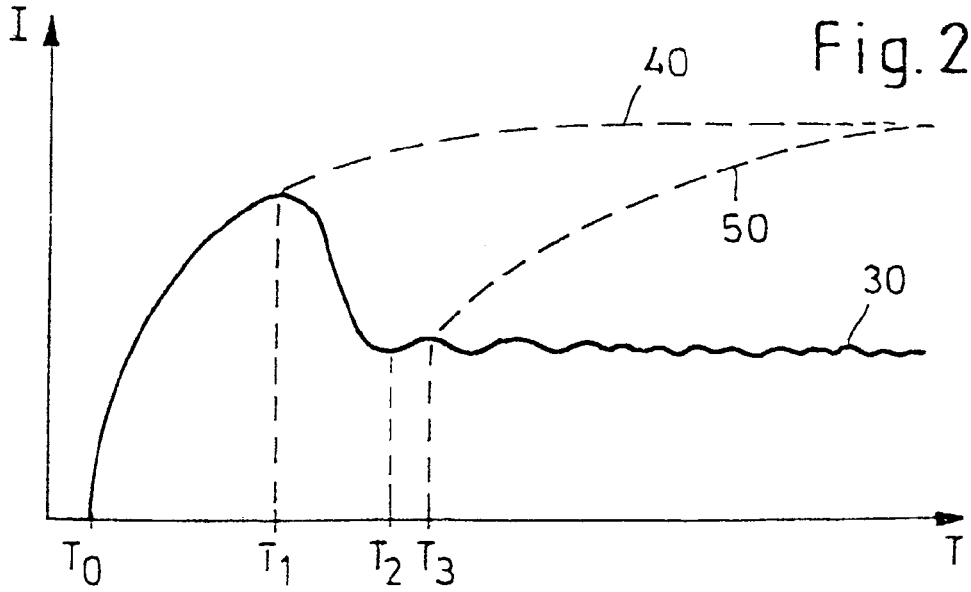

An example of a method and a device for operating an electro-magnet on an intrinsically safe direct current circuit in accordance with the present invention will now be described with reference to the accompaning drawing, in which:

FIG. 1 shows an electro-hydraulic control valve symbolically with two individual magnets and two multi-way valves as well as an associated control device; and FIG. 2 shows a graph of current against time showing the current behaviour measured according to the present invention in an electro-magnet with retaining current reduction in a graphical form.

An electro hydraulic control 10 in FIG. 1, is constructed in a modular manner and comprises an electro-magnet housing 1 of ferro magnetic material with two electro-magnetic inserts 2, 3 which each as has been previously proposed, has an armature, not shown, which can be moved too and fro between an starting position and a switched setting by the passing of current through an associated coil winding, similarly not shown. A valve block 4 is flanged onto the electro-magnet housing 1, which accepts two multi-way hydraulic valves 5, 6, which can be switched independently of each other using the electro-magnets 2, 3. FIG. 1 shows here the hydraulic valve 5 in the switched setting in which the load connection $A_1$ is connected to the high pressure line P whilst the hydraulic valve 6 is shown in the starting position, in which the load connection $A_2$ is connected to the return line T. The electro-hydraulic valve 10 further comprises an electronic housing 7 fastened to the electro-magnet housing 1 for the acceptance of an electronic control unit 20, with which inter alia the retaining current reduction is effected in the retaining phase of the electro-magnets 2, 3 which will not be further explained.

The electro-magnets 2, 3 are connected via the electronic control unit 20 to an overall face controller and are supplied with direct current from an intrinsically safe direct current circuit over the lines 8, 9 or a bus. The electronic control unit 20 comprises a microprocessor 21 to perform the method according to the present invention as a regulating device for the retaining current reduction as well as a pulse width modulator unit 22 for the reduction of the current fed in to the lower level of retention without losses or heating. After the interruption of the current feed to the coil windings of the electro-magnets 2, 3 their armatures and the closing body of the hydraulic valves 5, 6 are moved back by the return springs 11, 12 into the starting position.

The performance of the method according to the present invention is now explained with reference to FIG. 2. The graph in FIG. 2 shows schematically three curves 30, 40, 50 whereby curve 30 shows the curve of the actual current set up and measured according to the invention on the coil winding of one of the electro-magnets 2, 3 following the excitation and current feeding of the electro-magnet. The curve 40 shows the measurable current curve in a coil 40 with the omission of the armature movement and curve 50 shows the current curve measured for an electro-magnet with movement of the armature, however without reduction of the holding current.

The current rise in the coil winding of an electro magnet can be described with a coil of inductivity L and loss resistance R with the application of a constant voltage U by the equation:

$$i(t) = \frac{U}{R} * (1 - e^{\frac{t*R}{L}})$$

In an electro-magnet with a coil winding and armature, an opposing induction occurs in the coil winding during the pull-on phase of the armature owing to the movement of the armature, which in the current curve 30 coincides with a steep sided reduction of the current I taken by the coil winding between the time point $T_1$, which coincides with the beginning of the movement of the armature, and the time point $T_2$ at which the movement of the armature ends and the armature reaches the switched position. The time point $T_0$ in FIG. 2 corresponds to the actuation or switching on for instance of the electro-magnet 2. Hereby a relatively higher current flow is permitted by the control unit 20 so that the armature of the electro-magnet 2 can overcome the return force of the return spring 11 of the hydraulic valve 5 and the closing power of the closing body of the hydraulic valve 5. Between the points of time $T_0$ and $T_1$, an excitation current flows in the coil winding of the electro-magnet 2, possibly not influenced by the electronic control unit 20, using the full operating voltage available in the direct current circuit. At the point of time $T_1$ the movement of the armature of the electro-magnet 2 begins. This movement generates an opposing induction in the coil winding of the electro-magnet 2, which according to the invention is connected in series with a measurement resistor $R_1$ for the electro-magnet 2 or $R_2$ for the electro-magnet 3 which are dimensioned and designated for them. During the movement phase of the armature, current can continue to flow at the higher excitation level or the current feed level is already regulated at this point of time $T_1$. The actual current consumption of the coil winding which is set by the measurement resistors $R_1$ or $R_2$ of the electro-magnets 2, 3, falls away for a short time and the gradient of the measured current curve 30 between the time points $T_1$ and $T_2$ has a negative value. At time $T_2$ the sign of the gradient of the measured actual current changes afresh and becomes again positive. This point of time $T_2$ of the second sign change in the measured actual current forms consequently the optimum time for bringing in the retaining current reduction, since at this time point the armature and consequently also the closing body of the hydraulic valve has reached its switching position (opening position) and the retaining phase for the electro-magnet begins.

Now, according to the invention, using the microprocessor 21 a regulator device is realised, which for instance is designed in the software as a proportional regulator and based upon the test resistor $R_1$ or $R_2$ reduces the current fed to the coil windings of the electro-magnet 2 to the lower retaining current level. The retaining current level, at which the opening condition of the closing body of the hydraulic valve 5 itself is assured under pressure variations on the load, can be fed to the microprocessor 21 as target values parametrised in the software and the proportional regulator realised by means of the microprocessor 21 regulates the current fed in such that the measured actual current tracks the target value. Since the measured actual current serves as a regulating value even under-voltages or variations in the supply voltage do not lead to unintentional switching of the electro-magnet but the retaining current level required for attention is maintained. The output signal of the proportional regulator effected using the microprocessor 21 is fed to a pulse width modulation adjusting unit 22, which by pulsed control maintains the retaining current at the lower retaining current level.

In actual operation the reduction of the retaining current does not set in at the time point $T_2$ but only after a determined delay time at the time point $T_3$. At time $T_3$ the control device has detected and verified the gradient of current consumption of the coil winding of the actuated electro-magnet, cleaned up with respect to voltage variations. The time period between time point $T_2$ which corresponds to the actual change of sign in the measured actual current curve and time point $T_3$ at which the reduction in retaining current sets in, forms a safety period, which preferably can be adjusted by the software for the microprocessor 21. With the method according to the invention and the new type of retaining current reduction a switching current of 160 mA can be achieved, whereby time point $T_3$ is some 100 ms following the actuation of the associated electro magnet. The retaining current level can lie somewhere about 35 mA.

The continuous current measurement of the actual current in the coil windings of the electro-magnets 2 or 3 allows further for the use of electric, electronic, mechanical or magnetic determination of operating disturbances in the electro hydraulic value 10. Thus if the opposing induction does not occur then a warning signal can be given out that the associated electro-magnet has not switched. If the period between time points $T_1$ and $T_2$ is disproportionately extended it can be concluded that there is wear on the electro-magnet. Time point $T_1$ and the current strength measured at this point of time can be evaluated also with respect to the onset of wear. If the electro-magnet is connected to a bus, the switching condition of the armature can be read back and the resetting of the armature into the starting position following the disconnection of the electro-magnet can be monitored.

The invention claimed is:

1. A method of operation of an electro-magnet connected to an intrinsically safe direct current circuit of an underground electro-hydraulic installation, controlled to switch backward and forwards between two switching positions for the operation of the closing body of a hydraulic valve in the underground installation, whereby, by means of an electronic control unit an exciting current is fed to the coil winding of the electro-magnet in the pull-in phase of the armature of the electro-magnet and in the retaining phase of the armature a retaining current which is relatively lower than the exciting current is fed in, in which the actual current in the coil winding following the actuation of the electro-magnet is continuously measured and evaluated to detect the movement of the armature, and is used as a control value for the reduction of the current fed to the retaining current level, and in the retaining phase the current fed is kept to the lower retaining current level by pulsed control.

2. A method according to claim 1, in which the movement of the armature is detected using at least one change of gradient in the measured actual current curve.

3. A method according to claim 1, in which the measured actual current is taken to a regulator device, which closely following the onset of a second change of gradient in the measured actual current curve reduces the current fed to the lower retaining current level.

4. A method according to claim 3, in which the regulator device is formed from a proportional regulator, which regulates the current fed according to a target current.

5. A method according to claim 4, in which the target current is capable of being parameterised using control software.

6. A method according to claim 1, in which the electronic control has a microprocessor, which detects the onset of gradient changes in the measured actual current curve and by comparison with reference values evaluates these for fault diagnosis of operating disturbances and/or wear in the electro-magnets.

7. A method according to claim 1, in which in the retaining phase the current fed is kept to the lower retaining current level by pulse width modulation.

8. A device for the operation of an electro-magnet connected to an intrinsically safe direct current circuit of an underground electro-hydraulic installation, which is capable of being controlled backwards and forwards between two switching positions for the operation of the closing body of a hydraulic valve of the underground installation with an electro-magnet having a coil winding and an armature and with an electronic control unit, by means of which the current supplied in the pull-on phase of the armature can be adjusted to an exciting current and in the retaining phase to a lower retaining current, including a measuring device for the measurement of the actual current in the coil winding and an evaluating device for detection of a movement of the armature using the measured actual current, whereby the evaluating device comprises a microprocessor forming the electronic control device to which the measured actual current is capable of being fed as a control value for the reduction of the current feed in to the retaining current level and said electronic control device has a pulse with modulating unit for the adjustment and maintenance of the current fed to the lower retaining current level.

9. A device according to claim 8, in which the coil winding is connected in series with a test resistor for the measurement of the actual current.

10. A device according to claim 8, in which the electro-magnet has an electro-magnet housing of ferro magnetic material with two accepting borings for two electro-magnet inserts with associated coil windings and armatures.

11. A device according to claim 10, in which the electro-magnet has an electro-magnet housing of ferro magnetic material with two accepting borings for two electro-magnet inserts with associated coil windings and armatures, which is controlled via a common electronic control unit.

* * * * *